United States Patent [19]

Seward et al.

[11] Patent Number: 4,886,674

[45] Date of Patent: Dec. 12, 1989

[54] BEVERAGE MAKING CARTRIDGE

[75] Inventors: Barry Seward; Kevin C. Pope, both of Hampshire, England

[73] Assignee: Mars G.B. Limited, London, England

[21] Appl. No.: 195,387

[22] Filed: May 10, 1988

Related U.S. Application Data

[63] Continuation of Ser. No. 787,808, Oct. 16, 1985, abandoned.

[30] Foreign Application Priority Data

Oct. 23, 1984 [GB] United Kingdom ..... 8426741
Jul. 2, 1985 [GB] United Kingdom ..... 8516666

[51] Int. Cl.[4] ..... B65D 30/04; B65D 30/22; B65D 30/24

[52] U.S. Cl. ..... 426/79; 426/77; 426/78; 426/112; 426/120

[58] Field of Search ..... 426/112, 115, 124, 394, 426/433, 113, 77-84, 120; 99/295, 296, 287, 289 R, 289 T, 316, 317, 323, 319, 321; 222/129.1, 541; 206/.5; 383/80, 21, 93, 94, 904, 102, 103; 210/282, 484

[56] References Cited

U.S. PATENT DOCUMENTS

| | | | |
|---|---|---|---|
| 2,137,243 | 11/1938 | Heyman | 426/78 |
| 2,292,101 | 8/1942 | Brown . | |
| 2,328,018 | 8/1943 | Irmscher | 426/81 |
| 2,652,336 | 9/1953 | Hensgen et al. | 426/112 |
| 2,687,158 | 8/1954 | Owen | 383/80 |
| 2,778,739 | 1/1957 | Rodth . | |
| 2,783,704 | 3/1957 | Liebelt . | |
| 2,905,075 | 9/1959 | Liebelt . | |
| 2,935,929 | 5/1960 | Di Cara | 99/289 T |
| 2,968,560 | 1/1961 | Goros | 99/295 |
| 3,030,874 | 4/1962 | Fiori | 99/295 |
| 3,083,101 | 3/1963 | Noury . | |
| 3,087,491 | 4/1963 | Gewecke et al. | 383/21 |
| 3,165,114 | 1/1965 | Garrett | 383/904 |
| 3,199,437 | 8/1965 | Nelsen | 99/295 |
| 3,244,586 | 12/1965 | Wade . | |
| 3,292,527 | 12/1966 | Stasse | 426/115 |
| 3,344,734 | 10/1967 | Aguirre-Batress et al. . | |
| 3,346,388 | 10/1967 | Andrews et al. | 426/82 |
| 3,347,151 | 10/1967 | Ronalds | 426/77 |
| 3,352,226 | 11/1967 | Nelsen | 426/79 |
| 3,372,634 | 3/1968 | Brinkman et al. | 99/295 |
| 3,387,553 | 6/1968 | Tavera . | |
| 3,483,812 | 12/1969 | Gast et al. . | |
| 3,499,578 | 3/1970 | O'Neal | 426/115 |
| 3,554,256 | 1/1971 | Anderson | 383/80 |
| 3,589,272 | 6/1971 | Bouladon | 99/295 |
| 3,607,297 | 9/1971 | Fasano et al. | 426/433 |
| 3,615,708 | 10/1971 | Abile-Gal | 426/77 |
| 3,647,386 | 3/1972 | Gilford | 383/93 |
| 3,812,273 | 5/1974 | Schmidt . | |
| 3,833,740 | 9/1974 | Schmidt . | |
| 3,928,045 | 12/1975 | Tsunoda et al. | 426/113 |
| 3,935,318 | 1/1976 | Mihailide | 426/80 |
| 3,963,026 | 6/1976 | Herb | 383/80 |
| 4,007,674 | 2/1977 | Lichowsky | 99/289 R |
| 4,046,276 | 9/1977 | Winchell et al. | 383/80 |
| 4,126,167 | 11/1978 | Smith et al. | 383/80 |
| 4,136,202 | 1/1979 | Favre | 426/77 |
| 4,257,535 | 3/1981 | Mellett | 222/92 |
| 4,278,691 | 7/1981 | Donarumma et al. | 426/80 |
| 4,399,158 | 8/1983 | Bardsley et al. | 426/115 |
| 4,410,550 | 10/1983 | Gaskill | 426/77 |
| 4,415,085 | 11/1983 | Clarke et al. | 206/526 |

FOREIGN PATENT DOCUMENTS

| | | | |
|---|---|---|---|
| 1947146 | 12/1971 | Fed. Rep. of Germany | 99/295 |
| 2258462 | 6/1974 | Fed. Rep. of Germany | 426/112 |
| 2264208 | 7/1974 | Fed. Rep. of Germany | 426/77 |
| 2500131 | 7/1976 | Fed. Rep. of Germany | 426/78 |
| 2228374 | 11/1974 | France . | |
| WO8300611 | 3/1983 | Japan | 99/295 |
| 1180059 | 2/1970 | United Kingdom | 426/115 |
| 2121762 | 1/1984 | United Kingdom | 426/77 |

*Primary Examiner*—Steven Weinstein

*Attorney, Agent, or Firm*—Curtis, Morris & Safford

[57] ABSTRACT

A sealed beverage sachet containing a web material 8 supporting a beverage-providing product 14 and having a nozzle 16 to locate an aqueous medium injector into the sachet. The base seam of the sachet may be a heat- or pressure-sensitive seal 6. The web material 8 has a upwardly-directed seam 12 which everts when the sachet is used. The web material may be a filter for ground coffee or leaf tea, or a coarse mesh for dispersible products such as powdered chocolate or soups, or an impermeable web which is provided with means for releasing the sachet contents in use.

7 Claims, 2 Drawing Sheets

BEVERAGE MAKING CARTRIDGE

This is a continuation of application Ser. No. 787,808, filed 10/16/85, now abandoned.

This invention relates to beverage packages.

In U.K. Pat. No. 2121762A we described a system for obtaining beverages from, inter alia, sealed sachets containing a product providing a beverage when mixed with water, for example ground coffee or leaf tea. The sachet contains a filter material to retain the coffee grounds or tea leaves and preferably is provided with a plastics nozzle at the top to assist in locating the sachet correctly with a water-introduction injector. The base of the sachet is opened, for example by cutting or by the provision of a pressure- or heat-sensitive seal, an aqueous medium is introduced through the nozzle, and the beverage is collected from the opening in the sachet base.

One problem with such sachets arises from irregular base openings. When the base of a generally rectangular sachet is opened, the opening (produced for example by cutting off the lowest sachet seam) is roughly elliptical. The ellipse tends to pucker as the hot liquid leaves the sachet. This can cause an unpredictable direction of outflow for the liquid: the liquid does not necessarily stream vertically downwards. This is very undesirable and can lead to spillage of the beverage.

A further problem with such sachets is the means selected for providing the base opening. Cutting a fold forming the base seam is an obvious method, but this necessitates the provision of shears in the beverage machine. This increases cost and complicates maintenance. Self-opening seals—where the base seam is formed of, e.g. a pressure-sensitive adhesive—are an alternative, but these are not always entirely satisfactory. With a pressure-sensitive seal, which relies for its opening on the pressure of the aqueous medium being introduced into the sachet, as soon as a small opening appears in the base the air pressure in the sachet rapidly falls. It thus proves difficult to complete the opening in a reliable and reproduceable manner.

Another difficulty with such sachets is the use thereof to provide beverages where it is desirable to dispense the whole contents of the sachet into the beverage-receiving receptacle (e.g. cup). Typical examples of such products are water-dispersible or water-soluble soups, powdered chocolate, or syrups. With such products a fine filter material within the sachet will impede or prevent full dispensing. To omit a filter altogether also has its problems since the moment the sachet base is opened, the contents are released without mixing fully with the aqueous medium introduced into the sachet. This can lead to a poorly dispersed beverage possibly containing lumpy solids.

We have now devised improved sachets which enable these problems to be solved. This is achieved by including a web of material within the sachet (which web may or may not be a filter mesh) which is provided with an upwardly-facing seam which tends to evert when aqueous medium is introduced at the top of the sachet.

According to the invention there is provided a generally planar sealed beverage sachet formed of a substantially air- and water-impermeable sheet material, said sheet material enclosing and being attached to a web of material which supports a product which provides a beverage when mixed with an aqueous medium, said web material having a seam whose apex points upwardly towards said product, the sheet material having a base seam generally parallel to and below said web seam whereby to seal said web seam within the sachet, the arrangement being such that, when in use with aqueous medium being introduced into the sachet from the top thereof, said web seam tends to evert downwardly and the beverage is released from the sachet through an opening made therein at or adjacent to said base seam.

With infusion-type beverages where the product in the sachet (e.g. ground coffee or leaf tea) is to be retained therein after infusion, the web material will preferably be a laminar sheet of filter material of a sufficient mesh size to retain the infused solids.

With dispersion- or dissolution-type beverages, where the whole contents of the sachet are to be dispensed, the web material will preferably be a non-permeable laminar sheet or a relatively coarse mesh material. If it is a non-permeable sheet then some means should be provided to enable the sachet contents to be released. This means may be, for example, a frangible seal which opens upon introduction of the aqueous medium into the sachet. We have found that with dispersion-type drinks such as soups or powdered chocolate, the use of a relatively coarse mesh material is particularly advantageous. Upon introduction of the aqueous medium and eversion of the coarse mesh, a large proportion of the dispersible material is retained on the mesh for mixing with the aqueous medium, so as to leave the pack as a liquid dispersion rather than as undispersed particles. Even upon storage prior to use, the majority of the dispersible material remains on the correct side of the coarse mesh because the mesh itself is pressed in contact against the surfaces of the substantially air-and water-impermeable sheet material and little particulate material escapes into the volume below the web material.

It is preferred, but not essential, that the base seam be formed of a heat- or pressure-sensitive seal which is broken when a fluid medium such as air or water is forced into the sachet. Alternatively the base seam may be just a fold line in the air-and water-impermeable sheet material and which requires cutting prior to use of the sachet.

It is also preferred that the sachet includes a locating means for an aqueous medium-introducing means. This locating means is preferably a nozzle sealed in the top seam of the sachet.

The sachet may be generally rectangular, although in one embodiment the side seams taper inwardly in a downward direction.

Preferred sachets according to the invention are illustrated in the accompanying drawings, given by way of example, in which:

The sheet material 2 is a multilayer laminate such as (from the outside to the inside) polyester, aluminium foil, polyester, polypropylene. The filter material 8 is a laminate of melt blown polypropylene sandwiched between layers of non-woven spun-bonded polypropylene. The pressure-sensitive adhesive is a pressure-sensitive lacquer which is sold by E.I. du Pont de Nemours under the trade mark "Surlyn".

Figure 3:
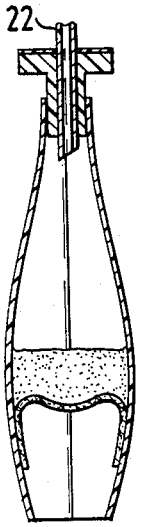
FIG. 3 is a similar section to FIG. 2 but with the sachet opened.

In use as shown in FIG. 3, hot water is introduced into the sachet through a hollow injector 22 which pierces barrier material 20 and enters delivery channel 18. The water pressure causes the filter material to evert about fold 12 to provide a generally flat plane or downwardly convex filter bed 24. The eversion effect assists in the rupture of the pressure-sensitive seal of seam 6. Because of the geometrical shape of area 10, the bottom opening to the sachet is generally elliptical and is formed in a reproduceable manner from sachet to sachet.

Figure 1:
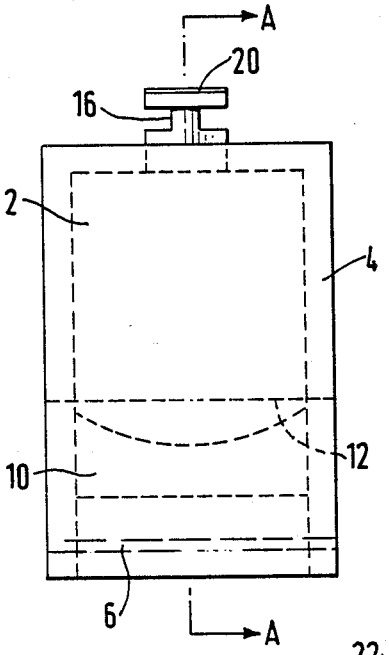
FIG. 1 is a front elevation of a sachet.
Figure 2:
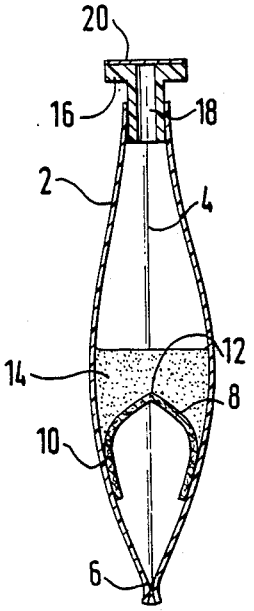
FIG. 2 is a section along the line A—A of FIG. 1, with the sachet sealed.
Figure 4:
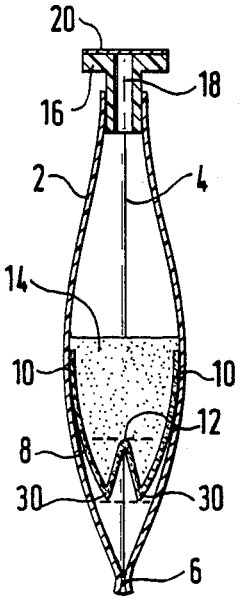
FIGS. 4, 5 and 6 are cross-sections of further sachets according to the invention.

Referring to FIG. 4, and using the same reference numerals to FIGS. 1 to 3, the illustrated sachet is identical to that shown in FIGS. 1 to 3 with the addition of the fact that the filter material 8 is provided with two further folds 30 such that the material is in the form of a W, the upper arms of which are adhered to the water- and air-impermeable material 2. The self-opening seal at the base of the sachet is shown at 6 and the evertable region of the filter material is indicated by the dotted lines.

Figure 5:
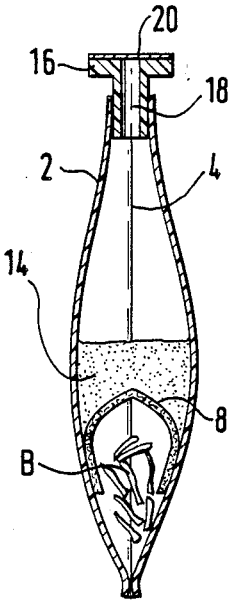

FIG. 5 shows a further embodiment, this time a sachet shown for dispensing chicken noodle soup. The web of sheet material 8 is a coarse mesh filter, the mesh openings being of sufficient size to allow the ingredients 14 thereabove to pass through when the sachet is opened. In this example the soup noodles are separated from the rest of the ingredients 14 and are stored in the sachet at B, below the coarse web 8. When the sachet is opened, as described above, the web everts and the noodles fall out of the sachet. Hot water enters the sachet through the nozzle and because the web tends initially to retain much of the ingredients 14 there is considerable dispersion thereof in the sachet and as they fall through the web. This arrangement improves dispersion and tends to avoid the formation of undispersed solid lumps in the final beverage. Typically the web 8 is polyethylene or polypropylene non-woven mesh, such as the product Net 909 commercially available from Smith & Nephew Plastics Limited, Gilberdyke, N. Humberside, U.K. A mesh size defined by a mesh weight of about 22 g/m$^2$ has been found appropriate for the purpose.

Figure 6:
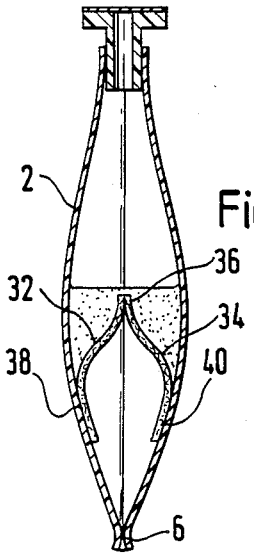

In the FIG. 6 embodiment, the web of sheet material 8 is formed as two separate non-permeable sheets 32 and 34 adhered together with a pressure-sensitive adhesive along a web seam 36 so as to form an upwardly directed inverted V-shape. The downwardly-directed arms of the inverted V are permanently adhered to sheet material 2 at 38 and 40. In use the inverted V first tends to evert and the pressure-sensitive bottom seam 6 opens. As pressure builds up, the pressure-sensitive seam 36 then parts to discharge the sachet contents.

Figure 7:
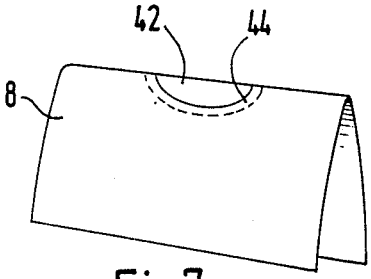
FIG. 7 is a perspective view showing the web material for use in a further embodiment of the invention Referring to FIGS. 1 to 3 the sachet shown is generally constructed in the manner as previously shown in FIG. 2 of U.K. Pat. No. 2121762A. It consists of two sheets of a water- and air-impermeable sheet material 2 welded together at seams 4. The bottom seam 6 is formed with a pressure-sensitive adhesive applied between the long dashed lines shown in FIG. 1. Within the sachet is an inverted V-shaped sheet of web material 8 which is a laminar sheet of filter material and which is adhered to the sheet material 2 on each side over an area 10 which is best described as rectangular, but with the top side of the rectangle being curved inwardly and downwardly rather than straight. The filter material 8 is provided with a center fold 12 whose apex points upwardly so that sheet material 2 and filter material 8, when bonded together, form, in the section shown in FIG. 2, a W-shape. The filter material 8 supports a beverage-providing product 14 and the top seam of the sachet incorporates a flanged nozzle 16 whose delivery channel 18 is obturated by a layer of a sheet barrier material 20.

Finally, in FIG. 7, a folded web of non-permeable sheet material 8 is shown for use in a sachet. This is a continuous sheet material with an opening 42 covered with a frangible seal 44 e.g. heat- or pressure-sensitive. When the sachet is opened and the web 8 everts, the frangible seal 44 ruptures to release the contents of the sachet. It is arranged that the material covering the opening 42 remains attached to the web 8 even after the seal 44 has ruptured.

We claim:

1. A generally planar sealed beverage sachet comprising, a product which provides a beverage when mixed in an aqueous medium, a substantially air- and water-impermeable sheet material defining opposing panels sealed to each other by a seam along an upper portion of said sachet, a pair of side seams and a base seam to enclose said product which is contained therein, a web of material adhered to both of said opposing panels of said sheet material between said side seams and between said base seam and the upper portion of said sachet, said base seam being a self-opening, pressure sensitive seal which is automatically releasable thus allowing the base seam to open upon a liquid medium being introduced into the sachet under pressure through said upper portion above said web, said web material being water permeable and having a seam whose apex points toward said upper portion of said sachet with said product being disposed on the upper portion of said web material, and said web material when viewed in cross-section having an inverted, upwardly directed generally V-shaped portion of web material free from adherence to said opposing faces of said sheet material and configured to provide an assist to the opening of said base seal by everting downwardly towards said base seam upon introduction of said pressurized liquid medium through said upper portion above said web.

2. A sachet as set forth in claim 1 wherein said product is ground coffee or leaf tea and the web material forms a filter therefor.

3. A sachet as set forth in claim 1 wherein said product forms a beverage when dispersed or dissolved in said aqueous medium and said web material is a coarse mesh which releases said product when aqueous medium is introduced into the sachet and said base seam is opened.

4. A sachet as set forth in claim 1 wherein a locating means for an aqueous medium introducing means is provided on the sachet.

5. A sachet as set forth in claim 4 wherein said locating means comprises a nozzle attached to said sachet.

6. A sachet as set forth in claim 5 wherein said nozzle is attached to said upper seam of said sachet and is downwardly directed towards said base seam.

7. A sachet as set forth in claim 1 wherein additional non-soluble ingredients for the beverage to be formed are disposed in said sachet between said base seal and said web of material.

* * * * *